US007918151B2

(12) United States Patent
Vegliante et al.

(10) Patent No.: US 7,918,151 B2
(45) Date of Patent: Apr. 5, 2011

(54) FILM CUTTER ASSEMBLY

(75) Inventors: Paul Vegliante, Franklin Lakes, NJ (US); Sean Neiberger, Los Angeles, CA (US); Rudolf Pavlik, Lincolnshire, IL (US); Ian Kaiser, La Canada, CA (US)

(73) Assignee: AEP Industries, Inc., South Hackensack, NJ (US)

( * ) Notice: Subject to any disclaimer, the term of this patent is extended or adjusted under 35 U.S.C. 154(b) by 0 days.

(21) Appl. No.: 09/970,015

(22) Filed: Oct. 3, 2001

(65) Prior Publication Data

US 2002/0117038 A1 Aug. 29, 2002

(51) Int. Cl.
*B26D 5/10* (2006.01)

(52) U.S. Cl. ..... 83/614; 83/374

(58) Field of Classification Search ..... 83/175, 83/374, 471.3, 56, 614, 613, 455, 91; 225/91
See application file for complete search history.

(56) References Cited

U.S. PATENT DOCUMENTS

| | | | | |
|---|---|---|---|---|
| 3,199,394 | A * | 8/1965 | Castelli | 83/578 |
| 3,277,760 | A | 10/1966 | Keene et al. | |
| 3,549,066 | A * | 12/1970 | Wankow | 225/25 |
| 3,552,614 | A * | 1/1971 | Wilson et al. | 225/20 |
| 3,779,121 | A | 12/1973 | Lagain | |
| 3,821,815 | A * | 6/1974 | Larrable | 360/110 |
| 4,196,647 | A * | 4/1980 | Fish | 83/175 |
| 4,197,774 | A | 4/1980 | Singh et al. | |
| 4,202,233 | A * | 5/1980 | Larson | 83/745 |
| 4,210,043 | A * | 7/1980 | Urion et al. | 83/175 |
| 4,787,284 | A | 11/1988 | Chen | |
| 4,856,975 | A * | 8/1989 | Gearhart | 425/131.1 |
| 4,957,023 | A | 9/1990 | Chen | |
| 4,960,022 | A | 10/1990 | Chuang | |
| 5,022,154 | A * | 6/1991 | Johnson | 30/34.2 |
| 5,036,740 | A | 8/1991 | Tsai | |
| 5,103,710 | A | 4/1992 | Ross | |
| 5,228,373 | A * | 7/1993 | Welsch | 83/24 |
| 5,243,890 | A * | 9/1993 | Ober | 83/471.2 |
| 5,273,809 | A | 12/1993 | Simmons | |

(Continued)

FOREIGN PATENT DOCUMENTS

JP 58217576 A * 12/1983

OTHER PUBLICATIONS

Boston University's Physics page, "Electric Charge", Jul. 5, 2000, Sections 16.1-16.4, "http://physics.bu.edu/py106/notes/Charge.html".* "Phthalate Ester Plasticizers-Why and How They Are Used", P. R. Graham, Environmental Health Perspectives, vol. 3, (Jan. 1973), pp. 8, Published by: The National Institute of Environmental Health Sciences (NIEHS).*
Artifact 09741521MA from copending case U.S. Appl. No. 09/741,521 submitted by a third party. Jul. 1999.*

(Continued)

*Primary Examiner* — Keneth E. Peterson
*Assistant Examiner* — Sean Michalski
(74) *Attorney, Agent, or Firm* — Porzio, Bromberg & Newman, P.C.

(57) ABSTRACT

The present invention relates to a film cutter assembly in which a blade housing slides bilaterally along a pair of rails. The blade housing houses a blade. An elongated rail base is coupled or integral with a pair of rails. The rails are formed of a material which provides a cling property to hold the film to the rail and maintain the film in flat position before, during and after cutting. A double-side adhesive tape can be applied to a surface of the elongated rail base which is adapted for attaching the elongated rail base to a carton of film.

12 Claims, 9 Drawing Sheets

U.S. PATENT DOCUMENTS

| | | | | | |
|---|---|---|---|---|---|
| 5,292,046 | A | * | 3/1994 | Kaiser et al. | 225/19 |
| 5,398,576 | A | | 3/1995 | Chiu | |
| 5,421,231 | A | | 6/1995 | Break et al. | |
| 5,440,961 | A | | 8/1995 | Lucas, Jr. et al. | |
| 5,524,515 | A | * | 6/1996 | Boda | 83/455 |
| 5,611,255 | A | | 3/1997 | Evans | |
| 5,758,559 | A | * | 6/1998 | Capitao et al. | 83/614 |
| 5,768,968 | A | | 6/1998 | Park et al. | |
| 5,772,094 | A | | 6/1998 | Kaiser et al. | |
| 5,819,618 | A | | 10/1998 | Rodriguez | |

OTHER PUBLICATIONS

The Technology of Plasticizers by J. Kern Sears and Joseph R. Darby, John Wiley and Sons ISBN 0 471 05583 2, p. 304-307 and 460-464.

Bulletin from Teknor Apex Company—Polyvinyl Chloride, Flexible—APEX 3300-75, Manufacturer and General Product Data.

* cited by examiner

FILM CUTTER ASSEMBLY

BACKGROUND OF THE INVENTION

1. Field of the Invention

The present invention relates to a film cutter method and apparatus in which a cutting blade extends from the interior of a housing and is slidable along a pair of rails, the rails being formed of a material for attracting or adhering a film, thereby effectively and expeditiously cutting film, such as food service wrap.

2. Related Art

The present invention relates to an improved film cutter for plastic wrap. Conventional plastic wrap has many uses for covering foods before putting them in a refrigerator, microwave or other storage means. Typically, conventional thin plastic wrap is rolled on a rod and dispensed by pulling outward a section thereof for use, the extended plastic wrap is then cut off by a blade or zig-zag cutting device attached along the edge of a box in which the roll of wrap is housed. The problem with these devices is that the thin plastic wrap is easily distorted by sticking to itself due to static electricity. Also, a user can cut themselves on the exposed blade.

U.S. Pat. No. 4,957,023 describes a wrap dispenser with an automatic cutting device. A cutting device is fixed on a mount and is able to be slidably moved along a fixed track by way of a transmission mechanism powered by a motor that is in turn actuated by a number of batteries. This patent has the drawback of being cumbersome and expensive to manufacture.

Other conventional attempts have included cutting apparatus having a plurality of guide wheels to travel in a channel beneath a cutting surface. U.S. Pat. No. 5,440,961 describes a film cutting apparatus in which a plurality of guide wheels are supported in a channel for guiding a cutting device during travel. A rotatable cutting wheel is disposed within a semicircular housing. A top surface of a cutting plane is formed of a urethane tape to adhere the film to the surface during cutting. The above-described film cutter has the limitation that the guide wheels and rotating cutting wheel use complex mechanical interaction resulting in high manufacturing costs. This cutter also has the drawback that the urethane tape loses the ability with use to immobilize the film because of loss of the adhesiveness of the tape.

U.S. Pat. No. 4,197,774 describes a travelling cutter assembly in which an elongated track has a slot for slidably receiving and returning a cutter slide therein. The track has roughened upper surface elements. A cutting element includes a housing having a smooth lower surface that extends laterally for locally immobilizing the sheet by pressing it against the roughened track surface. The use of a roughened surface for immobilizing a material has the shortening that the film can only be immobilized against the surface upon application of pressure between the cutting device and the surface.

U.S. Pat. No. 5,398,576 describes a cutting device having a positioning unit formed of two elongated vertical side walls interconnected to a horizontal top wall to define a sliding space between the vertical side walls and under the top wall. A cutter includes a sliding body with two vertical plates and two horizontal plates extending from the vertical plates under the horizontal top wall. A blade is mounted in a notch of the cutter. The blade extends rearwardly and downwardly from the front end surface. This patent has the disadvantage of exposure of the blade to a user and difficulty of the blade cutter bunched or misaligned film.

It is desirable to provide an improved film cutter apparatus overcoming the above-described deficiencies in which the apparatus can be used to conveniently and effectively cut film.

SUMMARY OF THE INVENTION

The present invention relates to a film cutter assembly in which a blade housing slides bilaterally along a pair of rails. The blade housing houses a blade. The rails are formed of a material which provides a "cling" property to hold the film to the rail and maintain the film in a flat position before and after cutting.

In an embodiment of the present invention, an elongated rail base is coupled or integral with a pair of rails. A double-side adhesive tape can be applied to a surface of the elongated rail base which is adapted for attaching the elongated rail base to a carton of film. The film cutter assembly can be disposable with the carton. Alternatively, the film cutter assembly is removable from the carton for re-use with a subsequent carton.

In an embodiment of the present invention, the blade housing is formed of an upper portion and a lower portion. The upper portion houses the blade. A channel is formed in the elongated rail base below the rails. The lower portion of the blade housing slides bilaterally in the channel. A pair of protrusions can extend from either end of the channel. The protrusions prevent the lower portion of the blade housing from being removed from the channel. The blade housing and protrusions can be formed of a shape for providing a snap fit to one another, thereby coupling the blade housing to an end of the channel before and after use.

The invention will be more fully described by reference to the following drawings.

DETAILED DESCRIPTION

Figure 1:
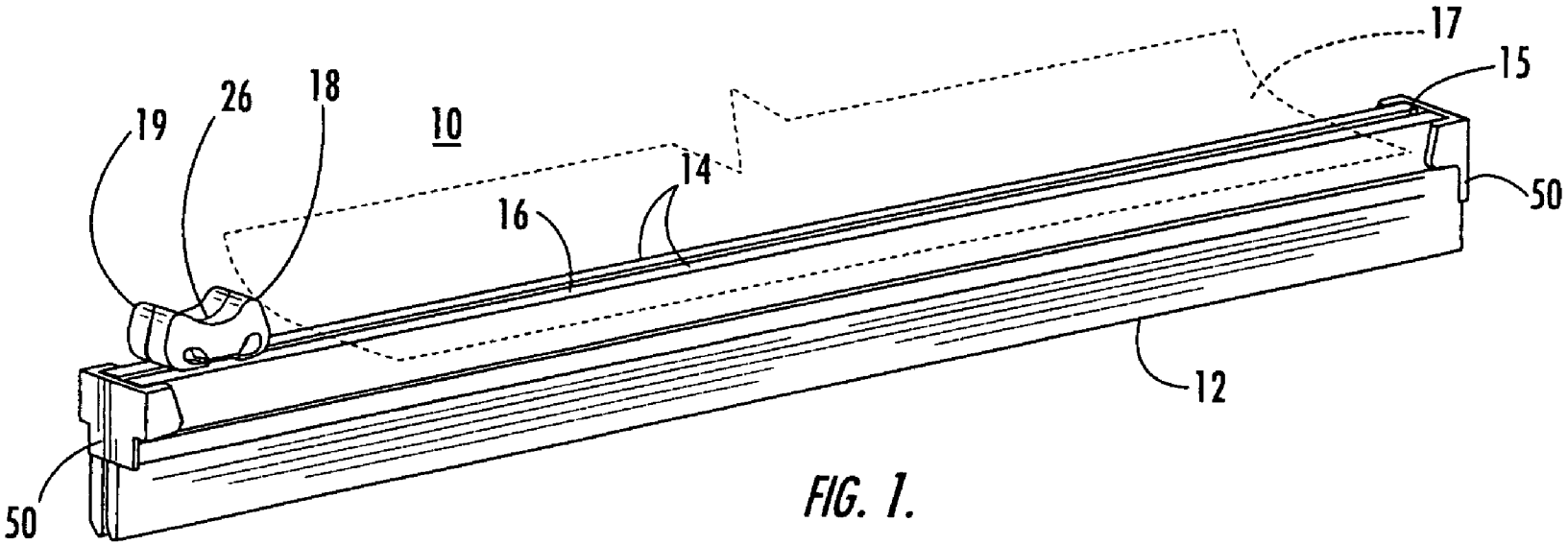
FIG. 1 is a front and side elevational view of a film cutter assembly in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
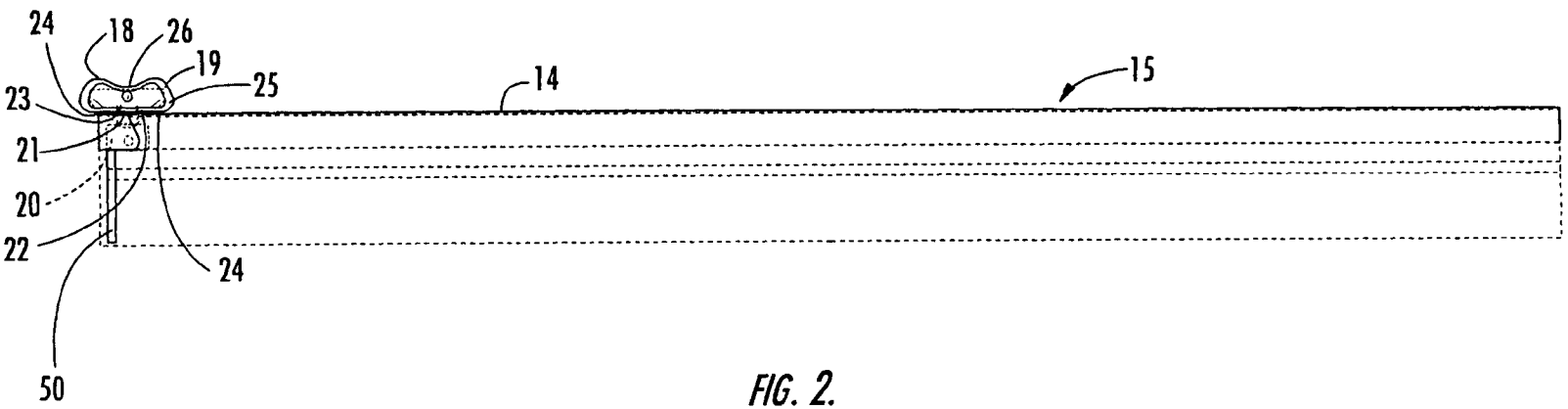
FIG. 2 is a side sectional view of the film cutter assembly in accordance with the teachings of the present invention.

FIGS. 1 and 2 illustrate film cutter assembly 10 in accordance with the teachings of the present invention. Elongated rail base 12 is coupled to a pair of rails 14 along top surface 16. Alternately, rails 14 are integral with elongated rail base 12. Channel 11 is formed below rails 14 and extends between rails 14. Film 17 is dispensed from a roll (not shown) and is pulled across rails 14. Film 17 can be any plastic film such as food service wrap. Elongated rail base 12 can have a length corresponding to the width of any size film. For, example, for a 12, 18 or 24 inches wide film elongated rail base 12 respectively has a length of about 13.2, about 19.2 or about 25.2 inches.

Elongated rail base 12 is formed of a first material having durability properties. For example, elongated rail base 12 can be formed of rigid plastic such as 87549 manufactured by Geon. Elongated rail base 12 can be formed of a light weight, inexpensive or disposable material.

At least an upper portion 13 of rails 14 is formed of a second material which provides cling property to hold film 17 to rails 14 and to help hold film 17 flat before, during and after cutting. Upper portion 13 of rails 14 can have a thickness in the range of about 0.001 inches to about 0.10 inches or about 0.015 inches. Alternatively, the second material forms substantially the entire rail 14. The second material can be a non-porous material for providing the cling property. The second material can be a smooth material for providing the cling property. Suitable second materials that can be used to provide a cling property include a material having a durometer (hardness) of 75 Shore A. Suitable second materials include materials having a durometer hardness of 10-90 Shore A. Suitable materials for upper portion 13 of rails 14 include plastic, rubber, glass, silicon elastimer, metal, acrylic, PVC or other flexible vinyl materials such as vinyl manufactured be Teknor as Apex 3300-75 NT or a combination of one or more of the materials or other conventional materials which provide a cling property to hold a film thereto.

Alternatively, upper portion 13 of rails 14 is formed of a material which provides adhesion to film 17. Suitable materials for upper portion 13 of rails 14 to provide adhesion or a tacky surface include a pressure sensitive adhesive, adhesive, natural rubber, rubber and rubber cement such as, for example, manufactured as Elephant Snot.

Co-extrusion can be used to form elongated rail base 12 and rails 14 from two different materials. Alternatively, rails 14 can be applied or coupled to elongated rail base 12. In an alternate embodiment, elongated rail base 12 and rails 14 can be both formed of a material that can provide a cling property.

In an alternate embodiment, one of rails 14 is formed of a material which provides cling properties or adhesion to a film and the other of rails 14 is formed of a material which can be the same or different as the material of elongated rail base 12.

Blade housing 18 is formed of upper portion 19 and lower portion 20. Middle portion 21 connects upper portion 19 to lower portion 21. Upper portion 19 of blade housing 18 houses blade 22. Lower portion 20 of blade housing 18 is received in channel 11 of elongated rail base 12.

Figure 4:
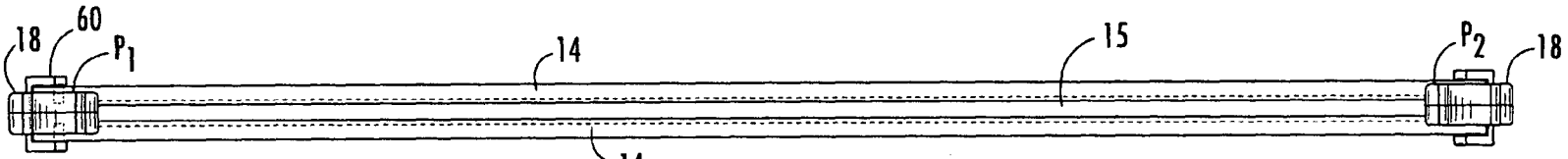
FIG. 4 is a top plan view of the film cutter assembly shown in FIG. 1.
Figure 3:
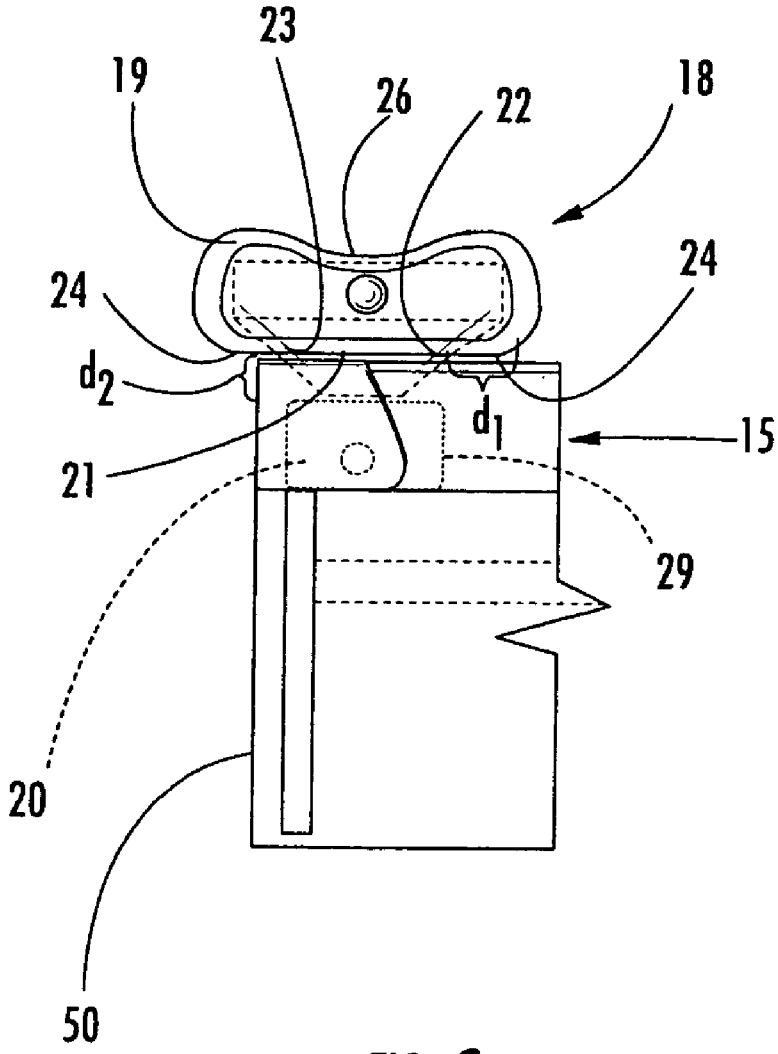
FIG. 3 is a side sectional view of a blade housing showing movement of the blade housing between end positions of an elongated rail base.

Bottom surface 23 of upper portion 19 includes bottom edge 24 which protrudes from blade 22 and prevents a user from contacting blade 22. Blade 22 protrudes from bottom surface 23 at a distance d1 behind end surface 25, as shown in FIG. 3. End surface 25 is upwardly inclined and rounded from bottom edge 24. End surface 25 and bottom edge 24 form a sled shaped runner to allow upper portion of blade housing 18 to slide back and forth along rails 14 between position p1 and position p2 and act in conjunction with rails 14 to keep film 17 from "bunching up" and allow film 17 to remain flat during sliding of blade housing 18 along rails 14, as shown in FIG. 4. Blade housing 18 has a low profile for providing a low center of gravity.

Preferably, blade housing 18 is formed of a flexible material having good lubricity for sliding along top surface 16 of rails 14 and within channel 11. For example suitable materials for blade housing 18 are acetal, such as RTP 801 manufactured by DEL or silicon. Alternatively, blade housing 18 can have a varied shape such as a flat bottom surface or can be any conventional blade housing or a conventional blade as described in U.S. Pat. Nos. 4,197,774; 4,787,284; 5,036,740 and 5,758,559 hereby incorporated in their entireties by reference into this application.

Upper portion 19 of blade housing 18 can include grip surface 26. Preferably, grip surface 26 is contacted by a finger of the user for moving blade housing 18. Grip surface 26 has a concave shape for allowing a user's finger to easily grip blade housing 18 and maintains a user's point of contact centrally on the top of the blade housing 18, thereby preventing rocking or teetering of blade housing 18.

Figure 5:
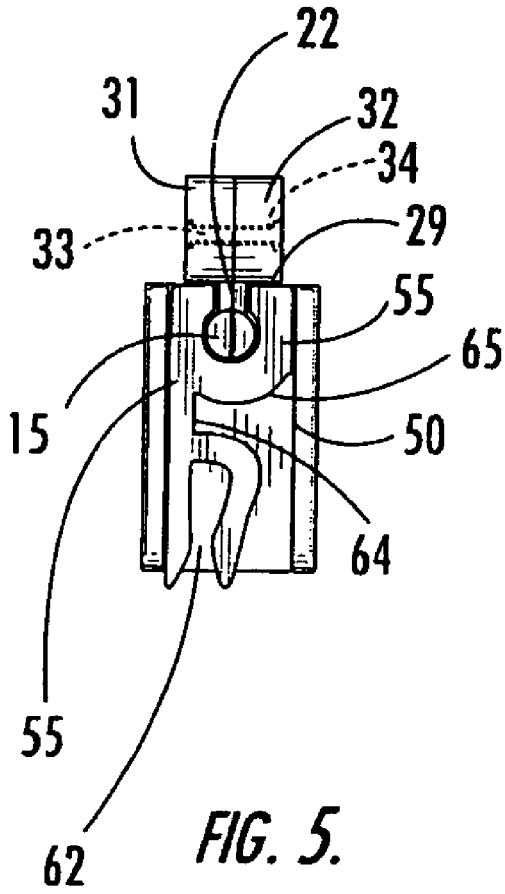
FIG. 5 is an end view of the film cutter assembly viewed from an end having the end cap removed.

Lower portion 20 of blade housing 18 forms a tracking device 29, as shown in FIG. 3. Tracking device 29 is received in channel 11 for bilaterally sliding along channel 11. Preferably, tracking device 19 has a tubular shape which slides in channel 11 having a corresponding tubular shape, as shown in FIG. 5. Middle portion 21 is selected to determine the distance d2 between tracking device 29 and blade 22. Distance d2 is selected to provide a predetermined clearance between blade 22 and rails 14 to allow blade housing 18 to be used with bunched or doubled over film.

Figure 6:
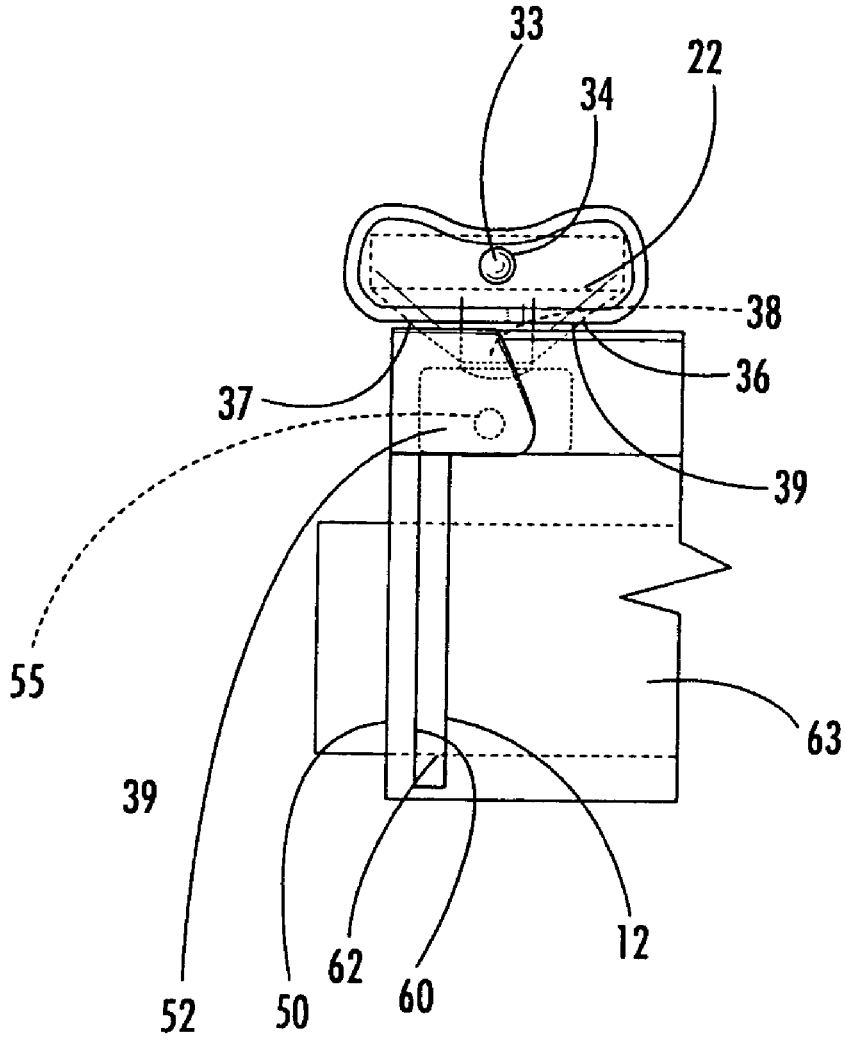
FIG. 6 is a side sectional view of the blade housing attached to a film carton.

Blade housing 18 can be formed of a two piece construction having a left section 31 and a right section 32, as shown in FIG. 6. Blade 22 is positioned between left section 31 and right section 32. Blade 22 is attached to left section 31 and right section 32 with rivet 33 extending through aperture 34 of blade 22. Rivet 33 secures blade 22 to a core of blade housing 18 for ensuring safety. Alternatively, a sonic weld or adhesive or other conventional methods can be used to secure blade 22.

Blade 22 can have angled side edges 36, 37. For example, side edges 36, 37 can be angled at a 30° angle from bottom surface 38 of blade 22. Cutting portion 39 extending from blade housing 18 is used to cut film 17. The blade angle provides optimal performance of cutting and reduces exposure of blade 22 to the user to allow blade 22 to cut film 17 and not a user's fingers. For example the preferred blade angle optimizes cutting of PVC and polyethylene film. Alternatively, blade 22 can have a rounded shape with a portion of the rounded shape forming the cutting portion. A suitable material for blade 22 is stainless steel.

End cap 50 is formed of a pair of male protrusions 52, which are integral with edge 55, as shown in FIG. 1 and FIG. 5. Male protrusions 52 snap onto female receptacles 55 positioned at both ends of elongated rail base 12. End cap 50 acts as a stop which retains blade housing 18 within elongated rail base 12 unless too much pressure is exerted against blade housing 18 at either end of elongated rail base 12 at which point end cap 50 releases from rail base 12 thus preventing failure of said blade housing and exposure of the user to said blade and resulting possible injury. Accordingly, blade housing 18 will remain intact and be removed from elongated rail base 12 if excessive force is applied to blade housing 18. A suitable material for end cap 50 is an acetal such as 2558-112 manufactured as Makralon or polycarbonate. Alternative methods can be used including a rivet, plug, glue, pinching, piercing or other applications known in the art to prevent blade housing 18 from escaping elongated rail base 12.

Rear edge 60 of elongated rail base 12 includes extension 62 forming a "u" shape, as shown in FIGS. 5 and 6. A side edge of a carton 63 is received in the "u" shape. Depression 64 is formed in rear edge 60 between extension 62 and outer surface 65 of channel 11. Depression 64 is adapted to receive a lid of the carton (not shown) and prevent movement thereof.

Figure 7B:
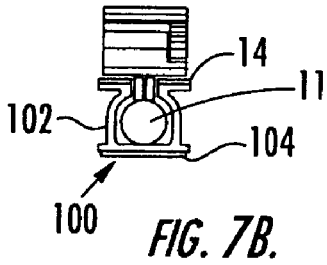
FIG. 7B is an end view of the film cutter assembly shown in FIG. 7A.
Figure 7A:
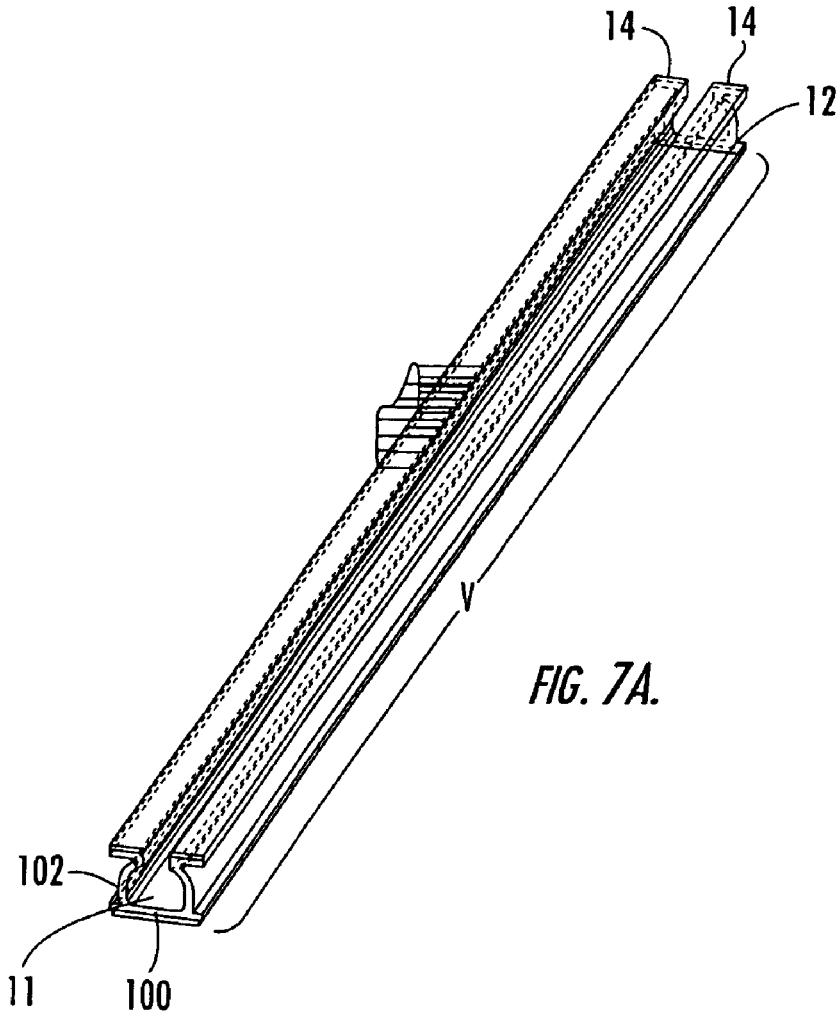
FIG. 7A is a perspective view of an alternate embodiment of a film cutter assembly.
Figure 7C:
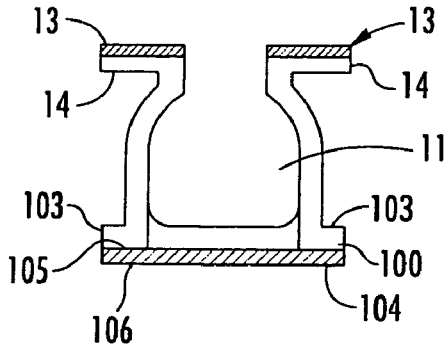
FIG. 7C is a cross sectional view of an elongated rail base of the film cutter assembly shown in FIG. 7A.
Figure 7E:
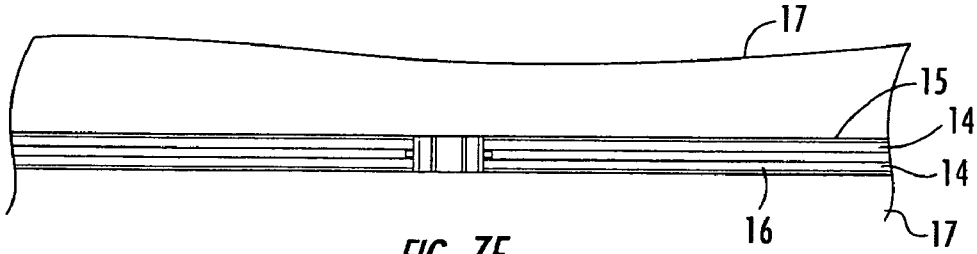
FIG. 7E is a top plan view of the film cutter assembly shown in FIG. 7A after cutting of a film.
Figure 7D:
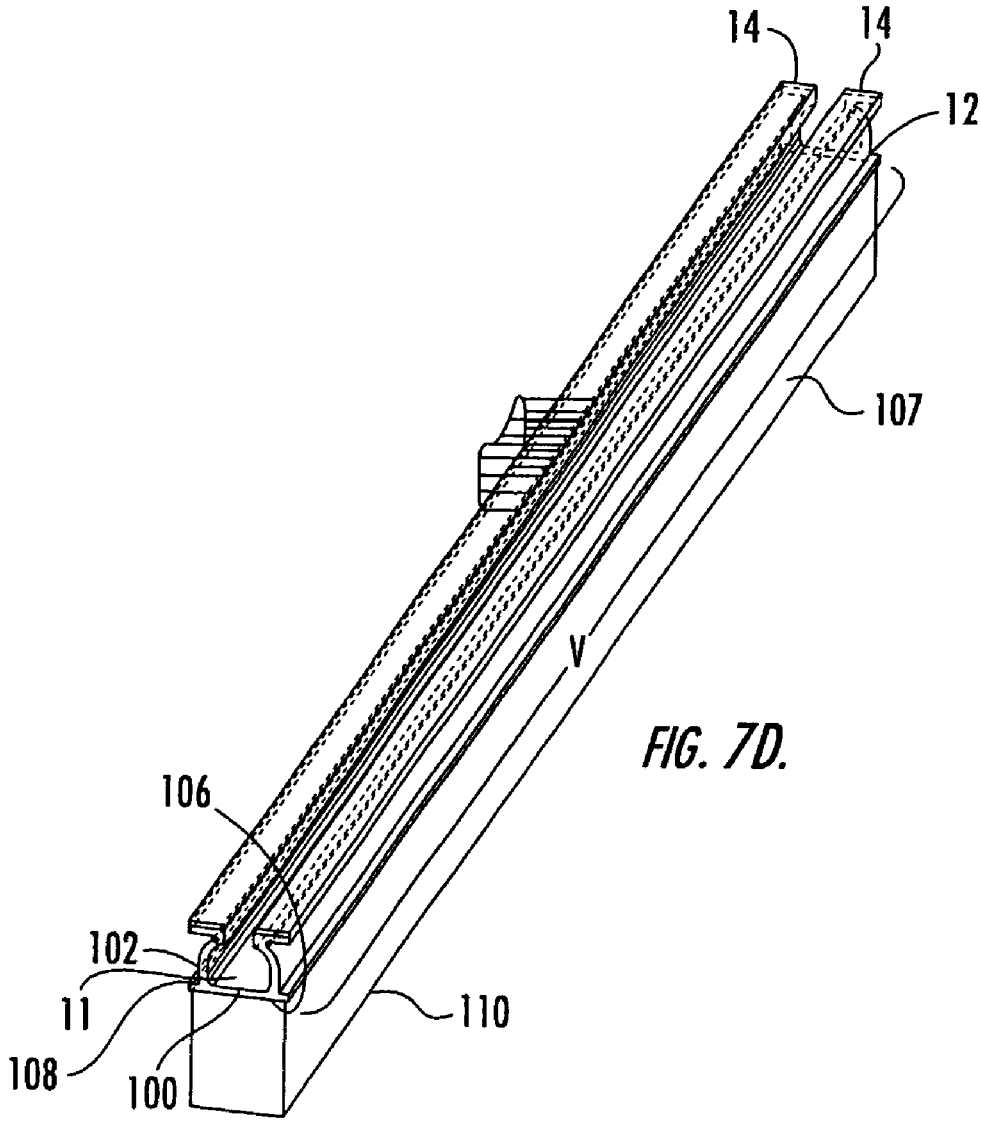
FIG. 7D is a perspective view of the film cutter assembly shown in FIG. 7A attached to a carton.

FIGS. 7A-E illustrate an alternate embodiment of the present invention. Lower portion 100 of elongated rail base 12 is integrally formed with side portion 102, as shown in FIG. 7A. Lower portion 100 is opposite to rails 14. Adhesive layer 104 is attached substantially along length L of lower portion 100, as shown in FIGS. 7A and 7B. Leg 103 extends on either side of channel 11 for providing increased surface area for the attachment of adhesive layer 104 to lower portion 100, as shown in FIG. 7C. For example, adhesive layer 104 can be a double-sided foam adhesive tape. Alternatively, adhesive layer 104 can be attached along one or more predetermined portions of lower portion 100. Surface 105 of adhesive layer 104 is adapted to be attached to lower portion 100 and surface 106 of adhesive layer 104 is adapted to attach to side 107 or top 108 of carton 110, as shown in FIG. 7D. Adhesive layer 104 can be attached to carton 110 by a user. Alternatively, adhesive layer 104 can be pre-installed and attached to carton 110 before receipt by a user. Film cutter assembly 10 can be formed of materials which are inexpensive to allow film cutter assembly 10 to be disposable.

Cling of film 17 to rail 14 holds the film in a tension state preventing the film from sliding or bunching up during the cutting process. The cling of film 17 to rail 14 keeps edge 115 of film 17 attached to rail 14 in a ready position for a next use. The cling of film 17 to rail 14 keeps edge 116 of film 17 which has been cut in place to allow the user two handed control of the film after a cut has been made, as shown in FIG. 7E.

Figure 8:
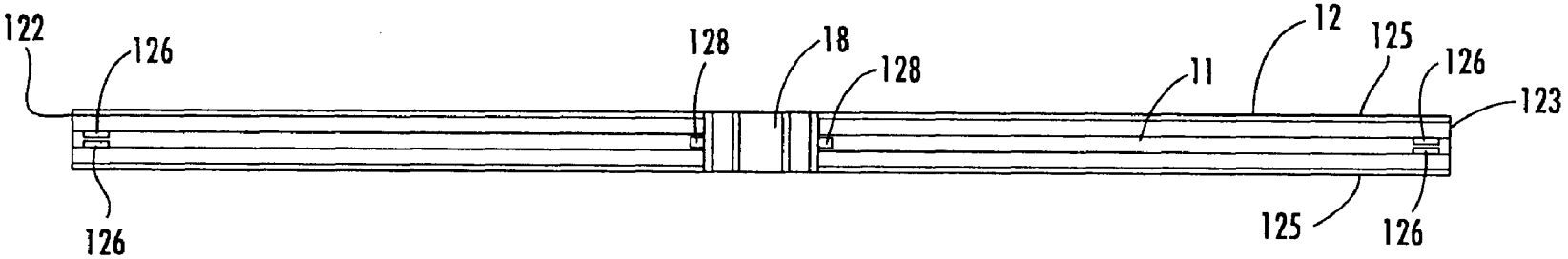
FIG. 8 is a top view of an elongated rail base of an alternate embodiment of a film cutter assembly.

FIG. 8 illustrates an alternative embodiment of the present invention. Protrusions 120 extend from end 122 and end 123 of channel 11 of elongated rail base 12. Protrusions 120 retain blade housing 18 in channel 11 and prevent blade housing 18 from being removed from channel 11 unless excessive force is applied to blade housing 18. Protrusions 120 can be cut from side wall 125 of elongated rail base 12 with a slicing or crimping process. Blade housing 18 can include protrusion 128 for snap fitting in space 129 or space 130 formed between protrusions 120. Blade housing 18 can snap into space 129 at end 122 when blade housing 18 is moved to end 122 after use, thereby retaining blade housing 18 at end 122 until the next use. Blade housing 18 can snap into space 130 at end 123 when blade housing 18 is moved to end 123 after use, thereby retaining blade housing 18 at end 123 until the next use.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

We claim:

1. A film cutter apparatus for cutting plastic wrap comprising:

an elongated rail base;

at least two rails formed at a top surface of said elongated rail base and a channel formed within said rail base;

a blade housing including a non-rotationally mounted blade and no wheels, said blade housing bilaterally slidable along said at least two rails, a bottom edge of an upper portion of said blade housing protruding on either end from said blade and an end surface being slanted and inclined upwardly and from either end of said bottom edge, said blade is angled from a bottom edge of said blade housing and a lower sliding member to cut in both directions; and said lower sliding member slidably moving in said channel and a portion of said at least two rails being formed of a first material comprising polyvinyl chloride comprising at least 10% plasticizer which provides cling properties to said plastic wrap received over said at least one rail before, during and after cutting of said plastic wrap; and wherein said elongated rail base is formed of a second, different material of rigid PVC, said first material is coextruded with said second material.

2. The apparatus of claim 1 wherein said first material is smooth.

3. The apparatus of claim 1 wherein said lower portion is formed of a tracking device for slidably moving in said channel.

4. The apparatus of claim 3 wherein said tracking device is formed of a tubular base and said channel having a corresponding tubular shape.

5. The apparatus of claim 1 wherein said blade housing is formed of acetal or silicon.

6. The apparatus of claim 1 further comprising an adhesive layer adhered to said elongated rail base on a surface opposite of said at least one rail.

7. The apparatus of claim 1 wherein and further comprising a protrusion extending in said channel at either end of said channel.

8. The apparatus of claim 7 wherein said lower portion of said blade housing snap fits into said protrusion.

9. A method for cutting a plastic wrap comprising:

providing the film cutter of claim 1;

receiving said plastic wrap over said rails;

clinging said plastic wrap to said rails;

cutting said plastic wrap with the blade.

10. The method of claim 9 wherein said first material is non-porous.

11. The method of claim 9 wherein said first material is smooth.

12. The apparatus of claim 1 comprising an adhesive layer adhered to said elongated rail base on a surface opposite of said at least one rail.

* * * * *